US005932403A

United States Patent [19]

Powell et al.

[11] Patent Number: 5,932,403

[45] Date of Patent: Aug. 3, 1999

[54] SILVER HALIDE PHOTOGRAPHIC LIGHT SENSITIVE MATERIAL HAVING SILVER HALIDE EMULSION BLENDS IN THE FAST LAYER

[75] Inventors: Steven J. Powell, Rochester; John F. Sawyer, Fairport, both of N.Y.

[73] Assignee: Eastman Kodak Company, Rochester, N.Y.

[21] Appl. No.: 09/035,517

[22] Filed: Mar. 5, 1998

[51] Int. Cl.[6] ..... G03C 1/035

[52] U.S. Cl. ..... 430/506; 430/509; 430/567

[58] Field of Search ..... 430/506, 509, 430/567

[56] References Cited

U.S. PATENT DOCUMENTS

| | | | |
|---|---|---|---|
| 4,481,288 | 11/1984 | Yamada et al. | 430/506 |
| 4,639,410 | 1/1987 | Mochizuki et al. | 430/506 |
| 4,727,016 | 2/1988 | Bando | 430/567 |
| 5,824,460 | 10/1998 | Dickerson | 430/502 |

*Primary Examiner*—Mark F. Huff

*Attorney, Agent, or Firm*—Andrew J. Anderson

[57] ABSTRACT

A color negative photographic element is disclosed comprising at least one light-sensitive image dye-forming unit containing a plural number of silver halide emulsion layers having different levels of photographic sensitivity which are spectrally sensitized to the same color region, wherein the silver halide emulsion layer having the highest level of photographic sensitivity of the unit comprises at least 40 wt %, with respect to total silver halide in the layer, of a first silver halide emulsion comprising silver halide grains with an average equivalent circular diameter represented by $ECD_1$ and from 5 to 35 wt % of a second silver halide emulsion comprising silver halide grains with an average equivalent circular diameter represented by $ECD_2$, and the silver halide emulsion layer having the second highest level of photographic sensitivity comprises at least 40 wt % of a third silver halide emulsion having an average equivalent circular diameter represented by $ECD_3$, where the ratio of $ECD_2$:$ECD_1$ is at least 1.6 and the ratio of $ECD_1$:$ECD_3$ is at least 1.2. The invention results in increase in speed (or light sensitivity) of a light-sensitive silver halide photographic material while maintaining good graininess in the mid- to high-exposure regions.

20 Claims, No Drawings

SILVER HALIDE PHOTOGRAPHIC LIGHT SENSITIVE MATERIAL HAVING SILVER HALIDE EMULSION BLENDS IN THE FAST LAYER

FIELD OF THE INVENTION

This invention relates to color negative silver halide photographic light-sensitive materials, and more particularly to such materials comprising separate color records, at least one of which has two or more layers of varying sensitivity that are sensitive to substantially the same spectral region, the fastest (or layer with the highest light sensitivity) of which comprises a blend of silver halide emulsions.

BACKGROUND OF THE INVENTION

In the art of light-sensitive silver halide photographic materials for color, particularly light-sensitive silver halide photographic materials for photographing, they have been desired to be endowed with various requisite characteristics, such as high light sensitivity with good image quality. In general, however, higher sensitivity requires the use of silver halide grains having larger grain size, and hence attempts to raise sensitivity have inevitably encountered the problems of increased graininess. Therefore techniques for improving graininess while maintaining high sensitivity have been strongly desired.

One technique used in multi-layer color light-sensitive materials, particularly those where wide latitude for exposure is desired, is to divide a light-sensitive silver halide emulsion layer having light sensitivity to the same spectral wavelength region into plural layers, for example, 2 to 3 layers with different sensitivities. Each layer may be comprised of a silver halide emulsion of a particular size distribution, or multiple grain sizes may be used. Use of multiple layers also allows image quality to be more optimized in certain regions of exposure, such as in areas of low exposure where the highest sensitivity emulsions are used, or in areas of mid- to high-exposure, where less sensitive emulsions may be used.

Color negative films are a class of photosensitive materials that map the luminance (neutral) and chrominance (color) information of a scene to complementary tonal and hue polarities in the negative film. Light areas of the scene are recorded as dark areas on the color negative film, and dark areas of the scene are recorded as light areas on the color negative film. Colored areas of the scene are recorded as complementary colors in the color negative film: red is recorded as cyan, green is recorded as magenta, blue is recorded as yellow, etc. In order to render an accurate reproduction of a scene, a subsequent process is necessary to reverse the luminance and chrominance information back to those of the original scene. One such subsequent process is to optically print the color negative film onto another photosensitive material, such as a color print film or paper.

Photographers and cinematographers desire the noise level in their images to be as low as possible. To minimize image noise in color negative films, it is generally desirable to use the slowest, finest grain stocks that lighting conditions permit. Unfortunately, in many circumstances lighting conditions cannot be altered, either because of the subject material or location constraints. In such instances, the photographer or cinematographer has no choice but to use the most sensitive, albeit the noisiest, stocks available. Medium and high speed color negative stocks are often used in these applications. Film speeds of ISO and El 200 and greater, e.g., are preferred for applications containing critical shadow detail or otherwise for low light conditions.

One can always use larger size emulsions in the fastest layer, or layer with the highest sensitivity, to increase the sensitivity of a film to light, but this generally increases the graininess of the image across the entire range of exposure. This is particularly true where emulsions with the same sensitivity (or speed) to grain efficiency are used. Increasing grain size generally results in speed and granularity increases in a predictable relationship up to a maximum speed. Reports of these observations are illustrated by Farnell, "The Relationship Between Speed and Grain Size", *The Journal of Photographic Science*, Vol. 17, 1969, pp. 116–125, and Tani, "Factors Influencing Photographic Sensitivity", *Journal of Photographic Science and Technology*, Japan, Vol. 43, No. 6, 1980 (FIG. 1). For emulsions differing in average grain size below that size which produces maximum speed, the "predictable relationship" referred to above is this: each stop (0.3 log E, where E is exposure in lux-seconds) increase in speed is typically accompanied by a granularity increase of 7 grain units for emulsions in a series being compared which exhibit equal photographic efficiency. For example, assigning a relative log speed of 100 to a reference emulsion, when an emulsion of larger average grain size exhibits a relative log speed of 130 (each unit difference in log speed=0.01 log E) and exhibits a granularity that is increased by 7 grain units, the two emulsions are exhibiting the relationship in performance that the art has established to exist between emulsions of the same photographic efficiency.

For the above reasons, it would be desirable to provide a color photographic light-sensitive material which is excellent in graininess and high in sensitivity. It would be particularly desirable to provide such a film having an ISO or EI speed rating of 200 or higher.

SUMMARY OF THE INVENTION

As a result of investigations, the present inventors have found that it is possible to increase the speed (or light sensitivity) of a light-sensitive silver halide photographic material while maintaining good graininess in the mid- to high-exposure regions, by having in the highest sensitivity (or fastest) layer at least two emulsions of different grain size, where the minor component is a higher sensitivity, larger grain size emulsion.

In accordance with one embodiment of the invention, a color negative photographic element is disclosed comprising at least one light-sensitive image dye-forming unit containing a plural number of silver halide emulsion layers having different levels of photographic sensitivity which are spectrally sensitized to the same color region, wherein the silver halide emulsion layer having the highest level of photographic sensitivity of the unit comprises at least 40 wt %, with respect to total silver halide in the layer, of a first silver halide emulsion comprising silver halide grains with an average equivalent circular diameter represented by $ECD_1$ and from 5 to 35 wt % of a second silver halide emulsion comprising silver halide grains with an average equivalent circular diameter represented by $ECD_2$, and the silver halide emulsion layer having the second highest level of photographic sensitivity comprises at least 40 wt % of a third silver halide emulsion having an average equivalent circular diameter represented by $ECD_3$, where the ratio of $ECD_2$:$ECD_1$ is at least 1.6 and the ratio of $ECD_1$:$ECD_3$ is at least 1.2.

In preferred embodiments of this invention, the first and second emulsions of the fastest layer comprise tabular grain emulsions, more preferably high aspect ratio tabular grain silver halide emulsions.

Another preferred embodiment of the invention is provided wherein the most sensitive photographic layer of a green color record comprises sensitized high aspect ratio tabular grain silver halide emulsions.

In an especially preferred embodiment, the majority of the photographic light sensitive layers of the photographic element comprise sensitized high aspect ratio tabular grain silver halide emulsions.

DETAILED DESCRIPTION OF THE INVENTION

Photographic elements of the present invention are color elements and preferably contain dye image-forming units sensitive to each of the three primary regions of the spectrum (blue, green and red). The region from about 400 nm to 500 nm is generally referred to as blue light, the region from about 500 nm to 600 nm as green light and the region from about 600 nm to 750 nm as red light. Units sensitive to other regions of the spectrum or to more than three regions of the spectrum are also possible. At least one dye-forming unit of the element, preferably a green light-sensitive unit and more preferably each of a blue, green and red light-sensitive image dye forming unit of the element, is comprised of multiple emulsion layers sensitive to a given region of the spectrum. Such multiple layers comprise a fastest layer, or layer with highest level of photographic sensitivity, and a second fastest layer, or layer with second highest level of photographic sensitivity. Additional layers with decreasing levels of photographic sensitivity may also be present. In a preferred embodiment of the invention, the dye-forming unit comprises a fastest emulsion layer, a middle speed (second fastest) emulsion layer, and a slow (least fast) emulsion layer. The layers of the element, including the layers of the image-forming units, can be arranged in various orders as known in the art. Typically, in each unit sensitized to a given spectral region which comprises multiple silver halide emulsion layers, the highest sensitive layer will be at the remotest position from the element support.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The advantages of the invention are particularly important where a magenta dye image-forming unit is included in accordance with the invention, as the speed and grain performance obtained is particularly visually evident in the green region, to which the human eye is most sensitive. In some instances it may be advantageous to employ other pairings of silver halide emulsion sensitivity and dye image-forming couplers, as in the pairing of an infra-red sensitized silver halide emulsion with a magenta dye-forming coupler or in the pairing of a blue-green sensitized emulsion with a coupler enabling minus-cyan dye formation. The material can contain additional layers, such as filter layers, interlayers, overcoat layers, subbing layers, and the like. The layers of the material above the support typically have a total thickness of between about 5 and 30 microns. The total silver content of the material is typically between 1 and 10 g/m$^2$.

It is generally preferred to minimize the thickness of the photographic material above the support so as to improve sharpness and improve access of processing solutions to the components of the material. For this reason, overall thicknesses of less than about 25 microns are preferred and thicknesses of less than about 20 microns are even more preferred. It is additionally preferred to minimize the total thicknesses of the color forming layers as measured from the portion of a light sensitive layer closest to the support to the portion of a light sensitive layer furthest from the support. Total color forming layer thicknesses of between about 25 and 3 microns are generally useful, while thicknesses between about 20 and about 5 microns are preferred, and thicknesses between about 18 and 8 microns are most preferred. These lowered thicknesses can be especially enabled at manufacture by use of surfactants, polymers, and other coatings aids as known in the art so as to control surface tension and viscosity. Other polymeric materials, humectants, and gelatin plasticizers are known to improve hardening leading to better physical integrity and reduced sensitometric variability over time. Both sharpness and ease of processing may be further improved by minimizing the quantity of incorporated silver in the element. Total silver of less than about 7 grams per square meter is preferred and total silver of less than about 5 grams per square meter is even more preferred. Sharpness in color images is further improved by complete removal of silver and silver halide from the element on processing. Since more highly swellable elements enable better access of components of processing solutions to the elements of this invention, swell ratios above 1.25 are preferred, with swell ratios of between 1.4 and 6 being more preferred and swell ratios of between 1.7 and 3 being most preferred. The balance of total thickness, imaging layer thickness, total silver and swell ratio most suitable for an element intended for a specific purpose being readily derived from the image structure, color reproduction, sensitivity and physical integrity and photographic resistance to pressure required for that purpose as known in the art. Use of polymeric materials and gelatin levels as known in the art to further control these photographic and physical properties is recommended.

The photographic materials of this invention can have any photographic sensitivity known in the art. Use of the highest possible sensitivity while maintaining other useful properties is generally preferred in films designed for general use, while the lower sensitivities are more preferred in those situations demanding excellent image structure. In preferred embodiments of the invention, the blue, green and red color records are balanced for exposure to a particular illuminant, such as tungsten light or day light, intended to be used with material. A balanced color negative film when exposed by a sensitometer using light of a spectral distribution equivalent to the specified color temperature (e.g., Tungsten light 3200K color temperature or day light 5500K color temperature) and processed according to standard conditions generally results in the cyan, magenta and yellow dye layers having densities 0.2 above base density within 0.1 log H exposure of one another (speed balance).

The photographic materials of the present invention are preferably motion picture origination film materials. Such materials typically have a width of up to 100 millimeters (or only up to 70 or 50 millimeters), and a length of at least 30 meters (or optionally at least 100 or 200 meters). Manufactured motion picture materials are typically provided to a user with an Exposure Index (EI) speed value of the film indicated on the film or its packaging for either Tungsten or day light illumination, which EI speeds generally correspond to equal or higher ISO speeds. Materials in accordance with the invention enable relatively high speed films (e.g., Tungsten or daylight balanced EI 200 and above) which provide good perceived granularity.

In accordance with the invention, the ratio of $ECD_2$:$ECD_1$ is at least 1.6 and the ratio of $ECD_1$:$ECD_3$ is at least 1.2, where $ECD_1$ represents an average equivalent circular diameter of a first silver halide emulsion which makes up at least 40 wt % (preferably at least 50 wt % and more preferably at least 65 wt %) of the total silver halide content of the fastest layer of a light sensitive unit comprising multiple layers, $ECD_2$ represents an average equivalent circular diameter of a second silver halide emulsion which makes up a minor portion (from 5–35 wt %, preferably not more than 25 wt % and more preferably at least about 10 wt % and not more than 20 wt %) of the total silver halide content of the fastest layer, and $ECD_3$ represents an average equivalent circular diameter of a third silver halide emulsion which makes up at least 40 wt % (preferably at least 50 wt % and more preferably at least 65 wt %) of the total silver halide content of the second fastest layer. The equivalent circular diameter, or ECD, of a grain is the diameter of a circle having an area equal to the projected area of the grain.

The use of a minor fraction of a significantly larger average grain size emulsion in the fastest layer of a photographic element in combination with a significantly large fraction of a smaller average grain size emulsion which is itself larger in average grain size than a significant fraction of the second fastest layer silver halide emulsion results in an increase in speed with a minimal increase in the graininess in the mid- to upper-exposure ranges, where a majority of photographic images are exposed. The relative grain sizes for the first and second emulsions preferably are sufficient to provide a speed difference of from about 0.2 to 0.45 log E for single emulsion coatings, where speed is measured at 0.15 density units above minimum density on a D log E plot upon exposure to the relevant light spectrum and standard color negative processing. Where the second emulsion is not as large as set forth above in relation to the first emulsion, the first emulsion is not as large as set forth above in relation to the third emulsion, or the amount of the second emulsion is less than 5 wt %, the desired speed increase of the photographic element is not as significant as desired. Where the amount of the second emulsion exceeds about 35 wt %, excessive granularity results. The ratio of $ECD_2$:$ECD_1$ is preferably from 1.6 to 3, more preferably from 1.75 to 3, and most preferably from 2 to 2.5, and the ratio of $ECD_1$:$ECD_3$ is preferably from 1.2 to 3, more preferably from 1.5 to 3, and most preferably from 1.75 to 2.5 in order to optimize the effective speed increase while maintaining good grain. In order to provide relatively high speed photographic elements, a relatively large average grain size emulsion with a median $ECD_1$ being at least 1.3 micrometers and more preferably at least 1.5 micrometers is used as the first emulsion in the fastest layer, with the size of the second and third emulsions being established in accordance with the above ratios.

In the following discussion of suitable materials for use in elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure I." The Sections hereafter referred to are Sections of the Research Disclosure I.

The silver halide emulsions employed in the elements of this invention will be negative-working emulsions. Suitable emulsions and their preparation as well as methods of chemical and spectral sensitization are described in Sections I through IV. Color materials and development modifiers are described in Sections V and XXI. Vehicles which can be used in the elements of the present invention are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, and exposure alternatives in Section XVIII.

In addition to the couplers described herein, the materials of this invention can include additional couplers as described in *Research Disclosure* Section VII, paragraphs D, E, F, and G, and the publications cited therein. These additional couplers can be incorporated as described in *Research Disclosure* Section VII, paragraph C, and the publications cited therein.

The photographic elements of the present invention may also use colored couplers (e.g. to adjust levels of interlayer correction) and masking couplers such as those described in EP 213.490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps, for example, of bleaching or fixing to improve the quality of the image. Bleach accelerators described in EP 193,389; EP 301,477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain image-modifying compounds such as "Developer Inhibitor-Releasing" compounds (DIR's). Useful DIR's for elements of the present invention, are known in the art and examples are described in U.S. Pat. No. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167;

DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540, 653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Applications 83-09,959; 83-62,586; 90-072,629, 90-072,630; 90-072,632; 90-072,633; 90-072, 634; 90-077,822; 90-078,229; 90-078,230; 90-079,336; 90-079,338; 90-079,690; 90-079,691; 90-080,487; 90-080, 489; 90-080,490; 90-080,491; 90-080,492; 90-080,494; 90-085,928; 90-086,669; 90-086,670; 90-087,361; 90-087, 362; 90-087,363; 90-087,364; 90-088,096; 90-088,097; 90-093,662; 90-093,663; 90-093,664; 90-093,665; 90-093, 666; 90-093,668; 90-094,055; 90-094,056; 90-101,937; 90-103,409; 90-151,577.

The silver halide used in the photographic elements of the present invention may be silver bromoiodide, silver bromide, silver chloride, silver chlorobromide, silver chlorobromo-iodide, and the like. High bromide silver halide grains are particularly useful and preferred for color negative origination elements in accordance with the invention. The term high bromide is employed to designate silver halide grains that contain at least 50 (preferably 70 and optimally 90) mole percent bromide, based on silver, with any remaining halide being iodide, chloride, or mixtures thereof. Iodide can be present in such grains in levels up to saturation, but preferably is limited to less than 20 (optimally less than 10) mole percent, based on silver. The type of silver halide grains preferably include tabular, polymorphic, cubic, and octahedral. The grain size of each individual silver halide emulsion used in the elements of the invention may have any distribution known to be useful in photographic compositions, and may be ether polydispersed or monodispersed. Particularly useful in this invention are tabular grain silver halide emulsions, and the use of high aspect ratio tabular grain emulsions is especially preferred. The term tabular grain is defined as a grain having two parallel major faces that are each significantly larger than an other single crystal face. High aspect ratio tabular grain silver halide emulsions and other emulsions useful in the practice of this invention can be characterized by geometric relationships, specifically the Aspect Ratio and the Tabularity. The Aspect Ratio (AR) and the Tabularity (T) are defined by the following equations:

$$AR=ECD/t$$

and $$T=ECD/t^2$$

where the ECD is the equivalent circular diameter and t is the thickness of the grains, measured using methods commonly known in the art, are expressed in units of microns.

Specifically contemplated tabular grain emulsions are those in which greater than 50 percent, more preferably greater than 70 percent and most preferably greater than 90 percent, of the total projected area of the emulsion grains are accounted for by tabular grains having a thickness of less than 0.3 micron and an average tabularity (T) of greater than 25 (preferably greater than 50, and more preferably greater than 100). High aspect ratio tabular grain emulsions have an average aspect ratio AR greater than 8 and are most preferred to have an AR greater than 10. Preferred emulsions additionally can be characterized in that their average Tabularity is preferably greater than 50 for best sharpness while having good speed.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements. In preferred embodiments of the invention, the fastest light sensitive layer of the green color record comprises a blend of at least two sensitized tabular grain silver halide emulsions each having average aspect ratios greater than about 8. Use of tabular grain emulsions of such size in proportions in accordance with the invention are particularly effective for providing elements with good speed as well as a good grain position in mid and upper scale regions.

Emulsion tabularity increases markedly with reductions in tabular grain thickness. It is generally preferred that aim tabular grain projected areas be satisfied by thin ($t<0.2$ micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

The thicknesses of the silver halide emulsions employed in this invention may be advantageously adjusted for the purposes of improving film performance according to principles described in *Research Disclosure*, May, 1985, Item 25330. This disclosure teaches, by extrapolation from the optical properties of silver bromide sheet crystals, that the thicknesses of silver halide emulsions incorporated in specific photographic layers and sensitized to one spectral region may be chosen to enable either improved speed or improved sharpness behavior in other photographic layers incorporating silver halide emulsions sensitized to different regions of the spectrum. These improvements are said to occur because the light transmission and reflection properties of the silver halide emulsions are controlled in large part by their grain thicknesses. Further discussion on the relationship between the thickness of silver halide crystals and their reflectance properties can be found in Optics, by J. M. Klein, John Wiley & Sons, New York, 1960, pages 582 to 585. Further discussions as to optimizing emulsion grain thicknesses for improving sharpness are found, e.g., in U.S. Pat. No. 5,395,744, the disclosure of which is incorporated herein by reference.

In accordance with preferred embodiments, tabular grains of less than the specified thickness noted above account for at least 50 percent of the total grain projected area of the specified first, second and third emulsions. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventional teachings, such as those of the following: *Research Disclosure*, Item 22534, January 1983, published by Kenneth Mason Publications, Ltd., Emsworth, Hampshire P010 7DD, England; U.S. Pat. No. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The silver halide grains to be used in the invention may be prepared according to methods known in the art, such as those described in *Research Disclosure I* and James, *The Theory of the Photographic Process.* These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with compounds such as gold sensitizers (e.g., aurous sulfide) and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 800° C., as illustrated in *Research Disclosure,* June 1975, item 13452 and U.S. Pat. No. 3,772,031.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention may also usefully include a magnetic recording material as described in *Research Disclosure,* Item 34390, November 1992.

Photographic materials can be exposed to actinic radiation, typically in the visible region of the spectrum, to form a latent image as described in *Research Disclosure* Section XVIII and then processed to form a visible dye image as described in *Research Disclosure* Section XIX. Processing to form a visible dye image includes the step of contacting the material with a color developing agent to reduce developable silver halide and oxidize the color developing agent. Oxidized color developing agent in turn reacts with the coupler to yield a dye. Development is followed by the conventional steps of bleaching, fixing, or bleach-fixing to remove silver and silver halide, washing, and drying.

The elements of the present invention may be imagewise exposed with a normal exposure according to the illumination type and speed value indicated with the film or other manufacturer recommendations, and processed according to the processing conditions indicated on the film or its packaging. Alternative processing techniques, however, such as under or over exposure, can also be used with films according to the invention if desired.

By "indicated" in relation to the film speed and processing conditions, means that some designation is provided on the film or its packaging or associated with one or the other, which allows the user to ascertain the manufacturer's speed rating (or film processing conditions). Such a designation can be a film speed number (such as Exposure Index (EI) Film Speed, or ISO or ASA Film Speed), or in the case of processing conditions, an actual statement of the conditions or reference to a well-known standard processing method (for example, Kodak ECN-2 processing for motion picture color negative films). Alternatively, such a designation can be a film identification designation (such as a number or film name) which allows a user to match the film with the manufacturer's speed designation or processing conditions (such as from a catalogue, brochure or other source).

The following examples illustrate preparation of photographic elements of the present invention, and their beneficial characteristics.

EXAMPLE 1

Green-light sensitized silver iodobromide emulsions A to D are prepared by combining silver nitrate solution and aqueous alkali halide solution in a reaction vessel containing an aqueous gelatin solution and an excess of halide ion. The nuclei population is ripened with an ammonia digest followed by a period of grain growth. After addition of approximately 70% of the total silver, an iodide band is formed using silver iodide seeds. This is followed by addition of the remaining silver and halide to reach the indicated final size and halide concentrations. Emulsions A–C additionally have selenium added as a dopant during the make process. Excess halide is removed from the silver grains by washing and the emulsions are further concentrated using ultra filtration. Spectral and chemical sensitization is then conducted with the addition of an optimal level of thiocyanate, green spectral sensitizing dyes, sodium aurous (I) dithiosulfate, and thiosulfate. A finish modifier is also added. Emulsions A–C are spectrally sensitized with green sensitizing dyes GSD-1 and GSD-2, while Emulsion D is spectrally sensitized with green sensitizing dyes GSD-1 and GSD-3:

GSD-1

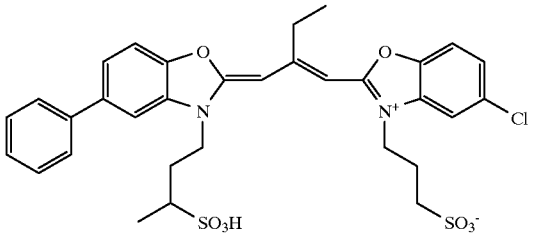

GSD-2

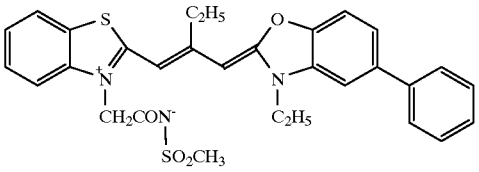

GSD-3

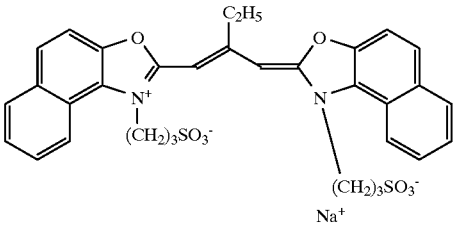

After addition of the chemical and spectral sensitizers, the emulsion is heated and held for an appropriate amount of time to finish the emulsion. Results yield polydispersed silver iodobromide emulsions, with emulsions A–C being optimally chemically and spectrally sensitized with the same compounds. The grain sizes (median width and thickness) and the silver iodide mole % for emulsions A–D are given in Table 1:

TABLE 1

| Emulsion Sample | ECD (Width) | Thickness | Silver Iodide Mole % |
|---|---|---|---|
| A | 3.4 | 0.115 | 3.8% |
| B | 1.54 | 0.142 | 4.5% |
| C | 0.75 | 0.142 | 4.5% |
| D | 0.5 | 0.112 | 3.0% |

Silver halide emulsion monolayer coating Sample 1.1 was prepared by coating the following layers on a subbed cellulose triacetate film with antihalation layer applied to back:

Layer 1: Magenta layer with couplers

Gelatin=1722 mg/m$^2$;

Coupler M-1=215 mg/m$^2$;

Coupler M-2=118 mg/m$^2$;

Coupler M-3=215 mg/m$^2$

Solvent S-1=172 mg/m$^2$

SILVER=861 mg/m$^2$ of Emulsion Sample A

Layer 2: Protective layer

Gelatin=4304 mg/m$^2$;

IDH=107 mg/$^2$

Hardener=1.75% (of gel) bis(vinylsulfonylmethyl)ether

Surfactants were added as coating aids where appropriate as is commonly done in the art. Compounds structures are listed below. Additional Samples 1.2–1.4 were similarly prepared as for Sample 1.1, except for varying the emulsion in Layer 1 as indicated in Table 2.

TABLE 2

| Sample # | Emulsion Sample | Total Ag (mg/m$^2$) |
|---|---|---|
| 1.1 | A | 861 |
| 1.2 | B | 861 |
| 1.3 | C | 861 |
| 1.4 | D | 861 |

Samples 1.1–1.4 were then exposed to green light through a wedge using a Wratten 99 filter and then processed in Kodak ECN-2 development process (a standard process for developing motion picture film) under standard conditions with the following specific steps:

| Step | Time | Temperature (°C.) |
|---|---|---|
| Pre-bath | 10 sec | 27 |
| Rinse/Remjet Removal | 20 sec | 32 |
| Developer | 3 min | 41.1 |
| Stop Bath | 30 sec | 32 |
| Wash | 30 sec | 32 |
| UL Bleach | 3 min | 38 |
| Wash | 1 min | 32 |
| Fixer | 2 min | 38 |
| Wash | 2 min | 32 |
| Final Rinse | 10 sec | 32 |

The formulations for the various ECN-2 processing solutions are as follows:

| | |
|---|---|
| Pre-Bath: | 20.0 g Borax (Decahydrated),<br>100 g Sodium Sulfate (Anhydrous),<br>1.0 g Sodium Hydroxide,<br>Water to make 1 L |
| Developer: | 2.0 mL KODAK Anti-Calcium No. 4 (Amino-tris(methylphosphoric acid) pentasodium salt),<br>2.0 g Sodium Sulfite (Anhydrous),<br>0.22 g EASTMAN Anti-fog No. 9 (3,5-Dinitrobenzoic acid),<br>1.20 g Sodium Bromide (Anhydrous),<br>25.6 g Sodium Carbonate (Anhydrous),<br>2.7 g Sodium Bicarbonate,<br>4.0 g KODAK Color Developing Agent CD-3 (4-Amino-N-ethyl-N-(β-methanesulfonamidoethyl)-m-toluidine sesquisulfate monohydrate),<br>Water to make 1 L |
| Stop Bath: | 50 mL Sulfuric acid (7.0 N),<br>Water to make 1 L |
| UL Bleach: | 0.07 mL Proxel GXL (1,2-Benzisothiazolin-3-one),<br>24.2 g KODAK Chelating Agent No. 1 (1,3-Propylene diaminetetraacetic acid),<br>30 mL Ammonium Hydroxide Solution (28%),<br>32.5 g Ammonium Bromide,<br>10.0 mL Acetic Acid (glacial),<br>28.8 g Ferric Nitrate (Nonahydrate),<br>Water to make 1 L |
| Fixer: | 2.0 mL KODAK Anti-Calcium No. 4 (Amino-tris(methylphosphoric acid) pentasodium salt),<br>185 mL Ammonium Thiosulfate Solution (58%),<br>10.0 g Sodium Sulfate (Anhydrous),<br>8.4 g Sodium Metabisulfite (Anhydrous),<br>Water to make 1 L |
| Final Rinse: | 0.14 mL KODAK Stabilizer Additive (Polyoxyethylene 12 tridecyl alcohol),<br>Water to make 1 L-- |

The films were then read for Status M densitometry, and relative sensitivity was measured. The results are list in Table 3. The results are expressed as a relative LogE number at the speed point.

Speed Point=LogE at 0.15 Density above Dmin.

Del Speed=Difference in LogE between Speed Point on Sample #1.2 and the respective sample.

TABLE 3

| Sample # | Emulsion Sample | Del Speed |
|---|---|---|
| 1.1 | A | +0.24 |
| 1.2 | B | — |
| 1.3 | C | −0.36 |
| 1.4 | D | −0.72 |

The above results indicate Sample 1.1 comprising 100 wt % Emulsion A is 0.24 log E, or 0.8 stop, faster than Sample 1.2 comprising 100 wt % Emulsion B.

EXAMPLE 2

Magenta monochrome coating Sample 2.1 comprising multiple silver halide emulsion layers each sensitized to the green light region was prepared by coating the following layers on a subbed cellulose triacetate film with antihalation layer applied to back:

Layer 1: Slow Magenta layer with couplers

Gelatin=925 mg/M$^2$;

Coupler M-1=89.3 mg/m$^2$;

Coupler M-2=86.1 mg/m$^2$;

Coupler M-4=38.3 mg/m$^2$

Coupler M-3=127 mg/m$^2$

Solvent S-1=102 mg/m$^2$

SILVER=484 mg/m$^2$ of Emulsion Sample D

Layer 2: Mid Magenta layer with couplers

Gelatin=1474 mg/m$^2$;

Coupler M-1=56 mg/m$^2$;

Coupler M-2=38.7 mg/m2;

Coupler M-4=24 mg/m$^2$

Coupler M-3=79.6 mg/$^2$

Coupler M-5=15.5 mg/m$^2$

Solvent S-1=63.8 mg/m$^2$

SILVER=1076 mg/m$^2$ of Emulsion Sample C

Layer 3: Fast Magenta layer with couplers

Gelatin=1291 mg/m$^2$;

Coupler M-1=50.6 mg/m2;

Coupler M-2=17.2 mg/m2;

Coupler M-4=21.6 mg/m$^2$

Coupler M-6=53.8 mg/m$^2$

Solvent S-1=36.2 mg/m$^2$

SILVER=861 mg/M$^2$ of Emulsion Sample B

Layer 4: Protective layer

Gelatin=1076 mg/m$^2$;

Coupler M-7=99.5 mg/m$^2$;

IDH=107.6 mg/m$^2$

Solvent S-1=43 mg/m$^2$

Hardener=2.00% (of gel) bis(vinylsulfonylmethyl)ether

Surfactants were added as coating aids where appropriate as is commonly done in the art. Compounds structures are listed below. Additional Samples 2.2–2.6 were similarly prepared as for Sample 2.1, except for partially substituting Emulsion A for Emulsion B in Layer 3 as indicated in Table 4.

TABLE 4

| Sample # | Weight % A | Weight % B | Total Ag (mg/m$^2$) |
|---|---|---|---|
| 2.1 | 0% | 100% | 861 |
| 2.2 | 10% | 90% | 861 |
| 2.3 | 20% | 80% | 861 |
| 2.4 | 30% | 70% | 861 |
| 2.5 | 40% | 60% | 861 |
| 2.6 | 50% | 50% | 861 |

Samples were exposed to white light through a wedge in a conventional manner and then processed as in Example 1 and then read for Status M densitometry. Relative sensitivity and graininess were measured. The results are list in Table 5. The results are expressed as differences from sample #2.1, using the following definitions:

Speed Point=LogE at 0.1 Density above Dmin, in sample #2.1

Del Speed=Difference in LogE between Speed Point on Sample #3.1 and the respective sample.

Grain Unit=5% change in RMS value, where RMS is the value of the standard deviation of density at various portions of density, (p. 619 Mees and James, 4th Ed) when those areas were scanned with a 48 micron aperture by means of a microdensitometer.

GNG=Gamma Normalized Grain, where the raw RMS measurement is divided by the contrast or gamma of the sample's sensitometric or characteristic curve at that portion of density. This allows comparisons to be made between variations on a equal gamma basis. The gamma at that portion of density is the first derivative of the curve as determined by conventional mathematical means.

Del GNG=Difference in GNG between Sample #2.1 and other samples.

LS=Lower scale portion of a sensitometric curve, defined as the area between the speed point and +0.60 LogE.

MS=Middle scale portion of a sensitometric curve, defined as the area between speed point +0.60 LogE and +1.80 LogE.

US=Upper scale portion of a sensitometric curve, defined as the area between speed point +1.80 LogE and +2.60 logE.

In general, the LS portion of the curve is where the objects with the least amount of exposure fall, such as shadows or underexposure; the MS portion is the range where most exposure fall; the US portion is where highlights or over-exposures fall.

In the table, the Del GNG numbers reflect the average change over the entire region noted, not just individual points.

TABLE 5

| Sample # | % Emulsion A | Del Speed | Del GNG/ LS | Del GNG/ MS | Del GNG/ US | "Expected" Del GNG* |
|---|---|---|---|---|---|---|
| #3.1 | 0 | — | — | — | — | — |
| #3.2 | 10 | 0.04 | 1.5 | 0.4 | 0 | 0.6 |
| #3.3 | 20 | 0.09 | 3 | 0.6 | 0 | 1.1 |
| #3.4 | 30 | 0.16 | 4 | 0.8 | 0 | 1.7 |
| #3.5 | 40 | 0.19 | 5 | 1.5 | 0 | 2.2 |
| #3.6 | 50 | 0.23 | 5.5 | 2 | 0.5 | 2.8 |

*"Expected" Del GNG is based on a historical increase of about 7 GU for use of an emulsion with a 0.30 LogE speed increase The example is a green light-sensitive magenta dye-forming monochrome unit from a color negative coating. Emulsion A is 0.24 logE faster than Emulsion B, which makes up the major fraction of the fast layer. An "expected"

change for a 0.24 LogE faster emulsion would be approximately 5.6 grain units @100% substitution. The table shows the effect of % Blends on granularity in various portions of exposure. Multicolor color negative elements in accordance with preferred embodiments of the invention may be prepared by additionally coating a red light-sensitive cyan dye-forming unit and a blue light-sensitive yellow dye-forming unit as is typical in the art.

As noted in the table, the speed increases as the percent of faster emulsion A increases. Although the lower exposure areas increase in granularity, the mid- to upper-scale granularity does not increase as significantly, particularly in the range of 5–35 wt % of the faster emulsion A. As many of the exposures for pictures are in the mid- to upper-scale ranges, this can be seen as an effective improvement in speed/grain efficiency for the mid- to upper-scale.

S-1

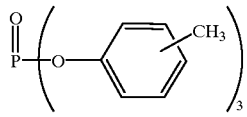

M-1

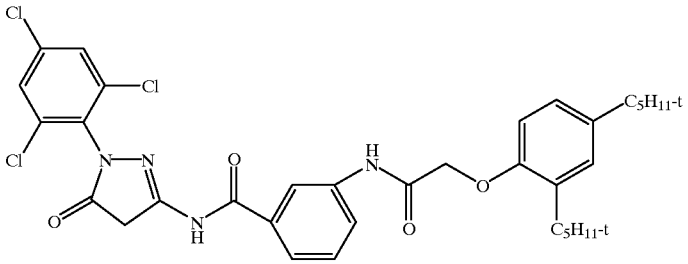

M-2

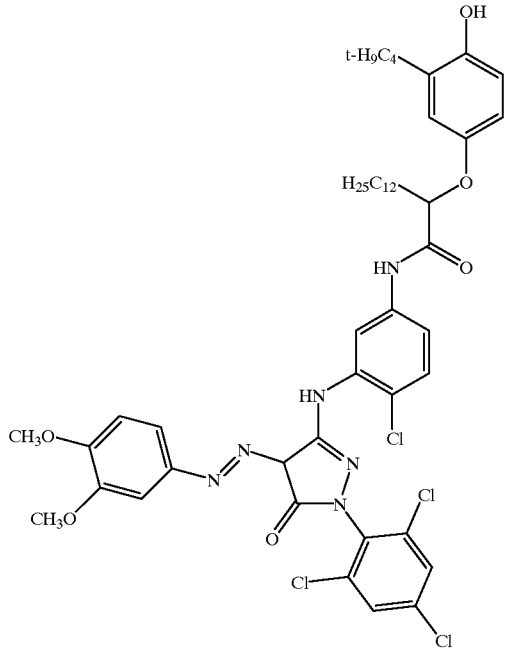

M-3

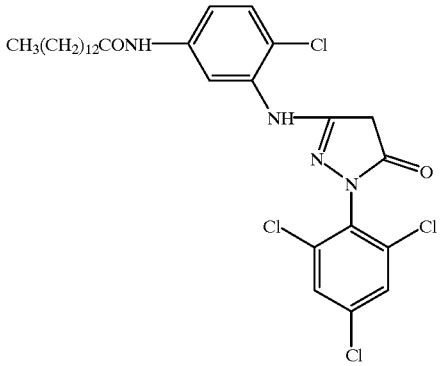

-continued
IDH
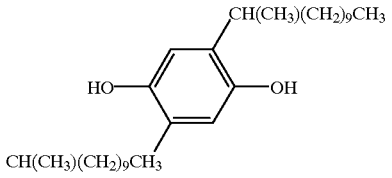
M-4
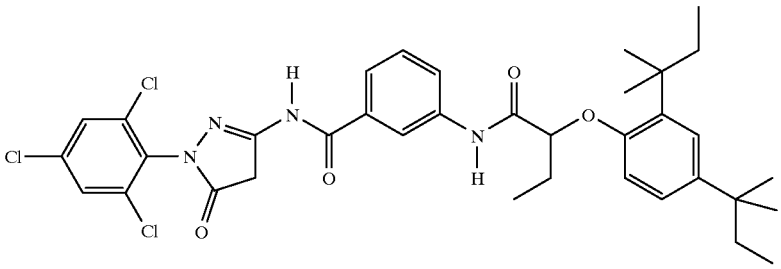
M-5
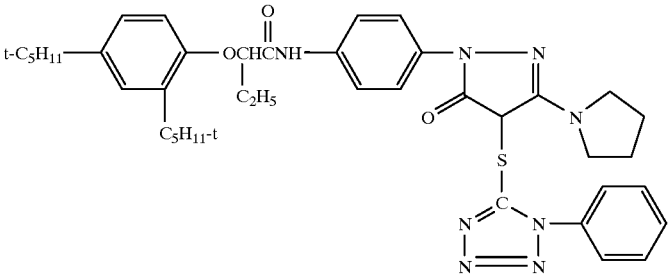
M-6
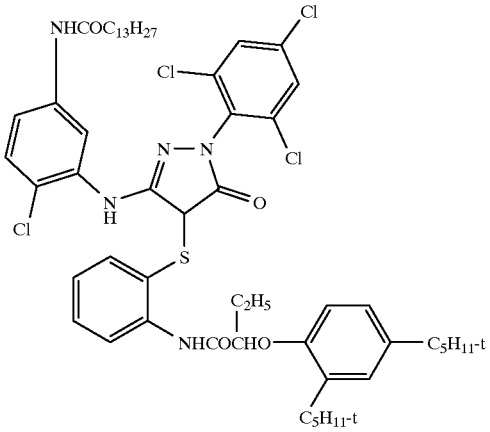

-continued

M-7

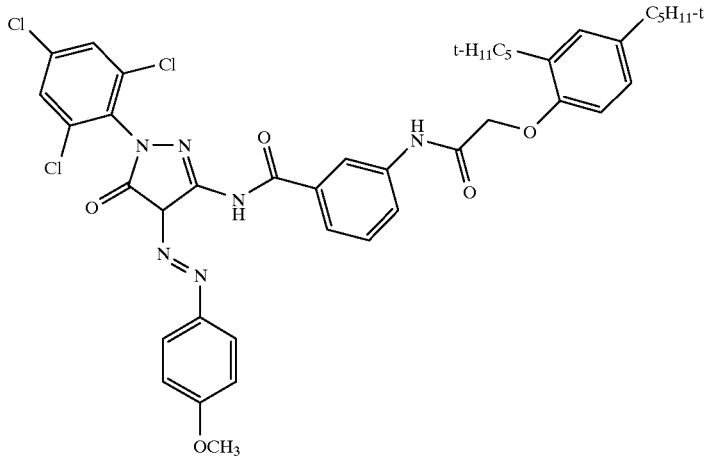

The invention has been described in detail with particular reference to certain preferred embodiments thereof, but it will be understood that variations and modifications can be effected within the spirit and scope of the invention.

What is claimed is:

1. A color negative photographic element comprising at least one light-sensitive image dye-forming unit containing a plural number of silver halide emulsion layers having different levels of photographic sensitivity which are spectrally sensitized to the same color region, wherein the silver halide emulsion layer having the highest level of photographic sensitivity of the unit comprises at least 40 wt %, with respect to total silver halide in the layer, of a first silver halide emulsion comprising silver halide grains with an average equivalent circular diameter represented by $ECD_1$ and from 5 to 35 wt % of a second silver halide emulsion comprising silver halide grains with an average equivalent circular diameter represented by $ECD_2$, and the silver halide emulsion layer having the second highest level of photographic sensitivity comprises at least 40 wt % of a third silver halide emulsion having an average equivalent circular diameter represented by $ECD_3$, where the ratio of $ECD_2$:$ECD_1$ is at least 1.6 and the ratio of $ECD_1$:$ECD_3$ is at least 1.2.

2. An element according to claim 1 wherein the ratio of $ECD_2$:$ECD_1$ is from 1.6 to 3.

3. An element according to claim 1 wherein the ratio of $ECD_2$:$ECD_1$ is from 1.75 to 3.

4. An element according to claim 1 wherein the ratio of $ECD_2$:$ECD_1$ is from 2 to 2.5.

5. An element according to claim 1 wherein the ratio of $ECD_1$:$ECD_3$ is from 1.2 to 3.

6. An element according to claim 1 wherein the ratio of $ECD_1$:$ECD_3$ is from 1.5 to 3.

7. An element according to claim 1 wherein the ratio of $ECD_1$:$ECD_3$ is from 1.75 to 2.5.

8. An element according to claim 1 wherein $ECD_1$ is at least 1.3 micrometers.

9. An element according to claim 1 wherein $ECD_1$ is at least 1.5 micrometers.

10. An element according to claim 1 wherein the silver halide emulsion layer having the highest level of photographic sensitivity of the unit comprises from 5 to 25 wt % of the second silver halide emulsion.

11. An element according to claim 1 wherein the silver halide emulsion layer having the highest level of photographic sensitivity of the unit comprises at least 50 wt % of the first silver halide emulsion.

12. An element according to claim 1 wherein the silver halide emulsion layer having the highest level of photographic sensitivity of the unit comprises at least 65 wt % of the first silver halide emulsion.

13. An element according to claim 1 wherein the silver halide emulsion layer having the second highest level of photographic sensitivity comprises at least 50 wt % of the third silver halide emulsion.

14. An element according to claim 1 wherein the silver halide emulsion layer having the second highest level of photographic sensitivity comprises at least 65 wt % of the third silver halide emulsion.

15. An element according to claim 1 wherein the plural number of silver halide emulsion layers having different levels of photographic sensitivity are spectrally sensitized to the green color region.

16. An element according to claim 15 wherein the image dye-forming unit comprises magenta dye-forming coupler.

17. An element according to claim 16 further comprising a light-sensitive cyan image dye-forming unit spectrally sensitized to the red color region and a light-sensitive yellow image dye-forming unit spectrally sensitized to the blue color region.

18. An element according to claim 1 wherein the first, second and third emulsions comprise tabular grain silver halide emulsions.

19. An element according to claim 18 wherein $ECD_1$ is at least 1.3 micrometers.

20. An element according to claim 19, wherein the ratio of $ECD_2$:$ECD_1$ is from 1.75 to 3 and the ratio of $ECD_1$:$ECD_3$ is from 1.5 to 3.

* * * * *